US006389834B1

(12) United States Patent
LeClear et al.

(10) Patent No.: US 6,389,834 B1
(45) Date of Patent: May 21, 2002

(54) CONDENSATE PUMPING SYSTEM FOR AIR CONDITIONERS

(75) Inventors: Douglas David LeClear, Coloma; Guolian Wu, St. Joseph; Kenneth Scheffler Scheffler, Benton Harbor; Jim J. Pastryk, Sawyer, all of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/789,199

(22) Filed: Feb. 19, 2001

(51) Int. Cl.[7] ..... F25B 47/00

(52) U.S. Cl. ..... 62/280; 62/262; 62/298; 62/263

(58) Field of Search ..... 62/280, 262, 298, 62/263

(56) References Cited

U.S. PATENT DOCUMENTS

| | | | | | |
|---|---|---|---|---|---|
| 2,320,436 | A | | 6/1943 | Hull | 62/129 |
| 2,672,024 | A | * | 3/1954 | McGrath | 62/6 |
| 2,753,699 | A | | 7/1956 | Gannon | 62/140 |
| 2,760,354 | A | | 8/1956 | Brady et al. | 62/129 |
| 3,797,270 | A | * | 3/1974 | Laing et al. | 62/333 |
| 5,167,131 | A | | 12/1992 | Karkhanis | 62/262 |
| 5,197,299 | A | * | 3/1993 | Sohn et al. | 62/262 |
| 5,461,880 | A | * | 10/1995 | Bolton et al. | 62/298 |
| 5,532,435 | A | * | 7/1996 | Bolton et al. | 174/135 |
| 5,582,025 | A | | 12/1996 | Dubin et al. | 62/262 |

* cited by examiner

*Primary Examiner*—William Doerrler
*Assistant Examiner*—Mark Shulman
(74) *Attorney, Agent, or Firm*—Robert O. Rice; Joel M. Van Winkle; Stephen Krefman

(57) ABSTRACT

The invention includes a liquid pumping system. The liquid is preferably condensate and the condensate pumping system may include a tank having an upper reservoir and a sump disposed below the upper reservoir. The upper reservoir may include an orifice and may be positioned to receive condensate from an evaporator. The condensate pumping system may also include a device to seal the orifice, a condensate tube connected to the sump, and an air pump attached to the sump through an air tube.

20 Claims, 8 Drawing Sheets

CONDENSATE PUMPING SYSTEM FOR AIR CONDITIONERS

The invention includes a system to push collected liquid from below a heat exchanger to a remote location.

BACKGROUND OF THE INVENTION

A heat exchanger may be a device used to transfer heat from a fluid on one side of a barrier to a fluid on the other side without bringing the fluids into direct contact. A heat exchanger system may include a coiled set of heat exchanging pipes and chilled coolant. Air conditioners, refrigerators, and freezers and dehumidifiers conventionally employ a heat exchanger system to remove heat from air that is local to the system. This heat eventually is transported to a remote location for disposal.

In operation, the chilled coolant of the heat exchanger system is circulated within the interior of the pipes to cool the exterior surface of the pipes. While the chilled coolant is circulated within the pipes, air from the local atmosphere is drawn over the exterior surface of the pipes. The cooled pipe exterior surfaces draw heat from the air so as to cool the air and heat the circulating coolant. As the heat exchanging process continues, the temperature of the local air decreases.

Atmospheric air includes nitrogen and oxygen as well as varying amounts of moisture. Thus, a side effect of drawing heat from the air at the surface of the pipes is that atmospheric moisture condenses on the heat exchanger pipes as condensate. This condensate builds on the pipes over time and eventually drips as water into a pan located below the heat exchanger pipes. The water collects as a pool in the pan.

The collected water is not supposed to evaporate back into the air. In some applications, the heat exchanging process results in more collected water than the pan can hold. For example, air conditioning systems condense much more water than can be stored. Here, it is desirable that this water be mechanically removed from the pan before the water fills the pan.

In a window based, saddle air conditioning system, the saddle air conditioner is hung over the bottom rail of a window sill so that the air cooling unit is located within a room and the heat discharging unit is located outside. Removing water from the pan of the air cooling unit may involve raising the pooled water up from the pan and over the bottom rail of a window sill. Conventionally, a water pump is used to remove the water from the pan and pass the water over the window sill. However, a water pump is noisy, bulky, and requires a relatively large amount of power to operate. When operating, the water pump causes vibrations throughout the air conditioner that, in turn, cause noise to emanate from the air cooling unit into the room. It is desirable to minimize these problems.

SUMMARY OF THE INVENTION

The invention includes a liquid pump system, and in the preferred embodiment, a condensate pumping system. The condensate pumping system may include a tank having an upper reservoir and a sump disposed below the upper reservoir. The upper reservoir may include an orifice and may be positioned to receive condensate from a set of evaporator coils. The condensate pumping system may also include a device to seal the orifice, a condensate tube connected to the sump, and an air pump attached to the sump through an air tube.

DETAILED DESCRIPTION OF THE INVENTION

Figure 1:
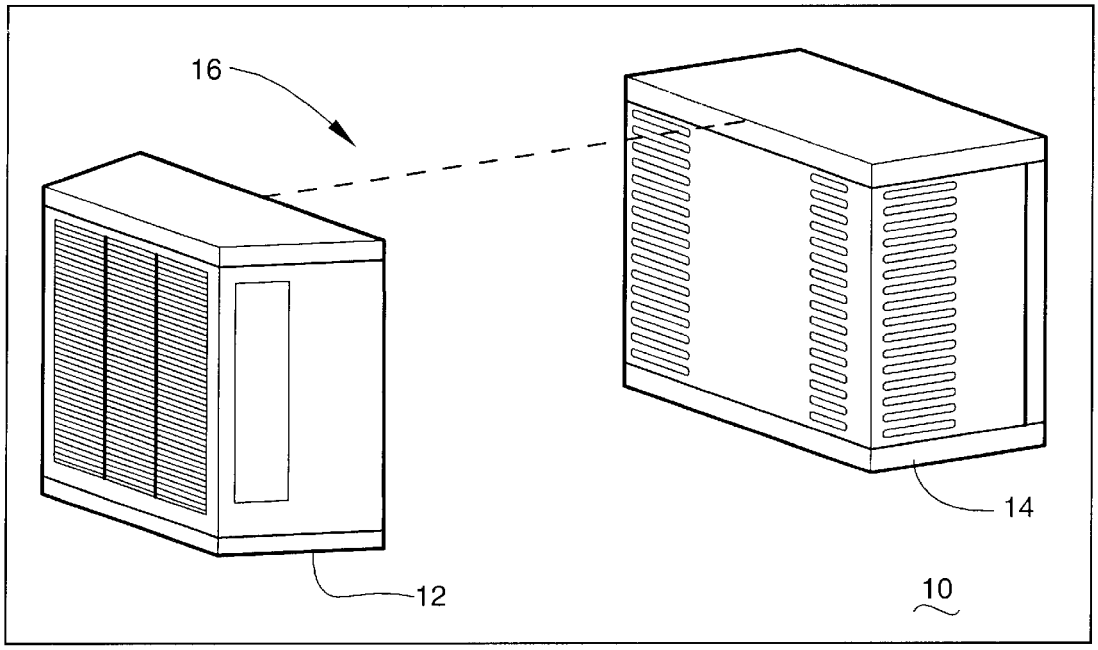
FIG. 1 illustrates a split air conditioner incorporating principles of the invention.

FIG. 1 illustrates a split air conditioner incorporating principles of the invention. Included with the air conditioner may be a local unit 12 and a remote unit 14. The local unit 12 may include an evaporation system that both absorbs heat from the surrounding environment into a working fluid and passes that heated fluid to the remote unit 14. The remote unit 14 may include a condensing system that may expel heat from the fluid to cool the fluid, where upon the fluid may be recirculated to the local unit 12.

Coupled between the local unit 12 and the remote unit 14 may be a supply system 16. The supply system 16 may include an adjustable structure that aids in routing condensate water from the local unit 12 to the remote unit 14. Under this arrangement, the air conditioner 10 may be viewed as a split air conditioner in that the adjustibility of the supply system 16 may permit a user to position the local unit 12 in any one of a number of orientations with respect to the remote unit 14. As graphically illustrated in FIG. 1, the air conditioner 10 may include a mini-split air conditioner, a portable air conditioner, and a saddle air conditioner.

Figure 2:
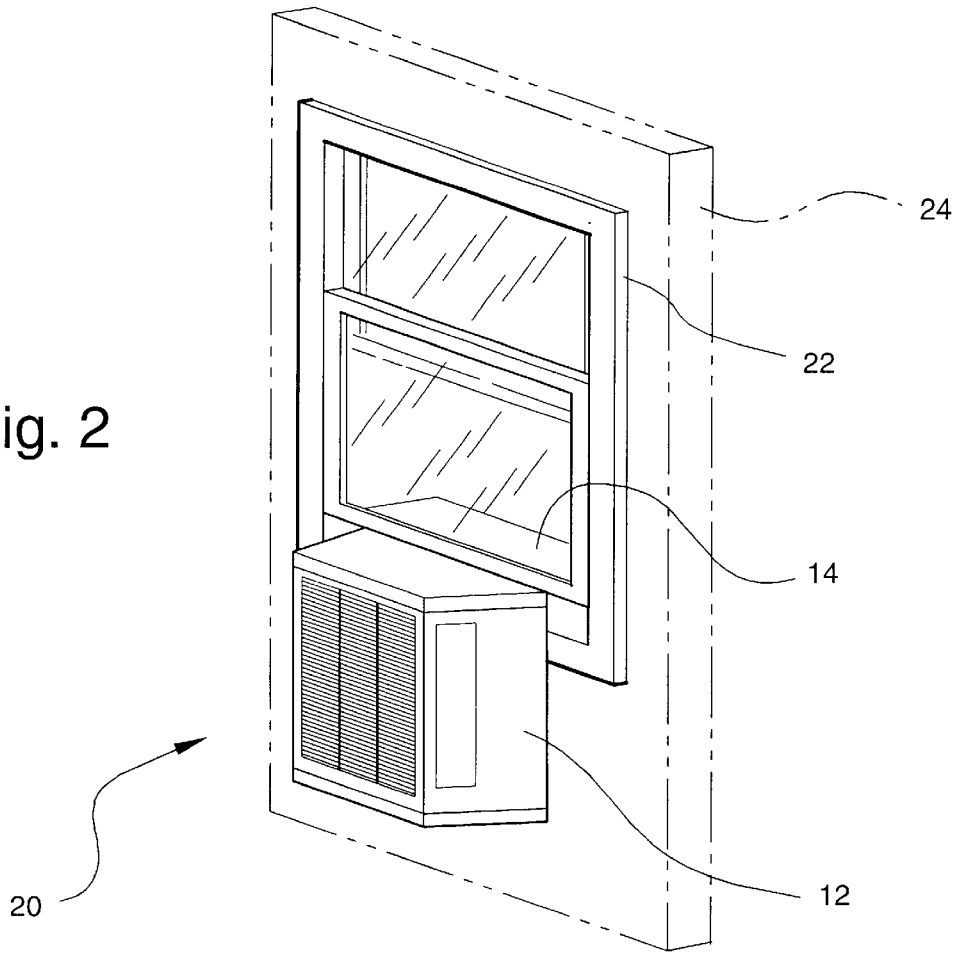
FIG. 2 illustrates a saddle air conditioner disposed within a window.
Figure 3:
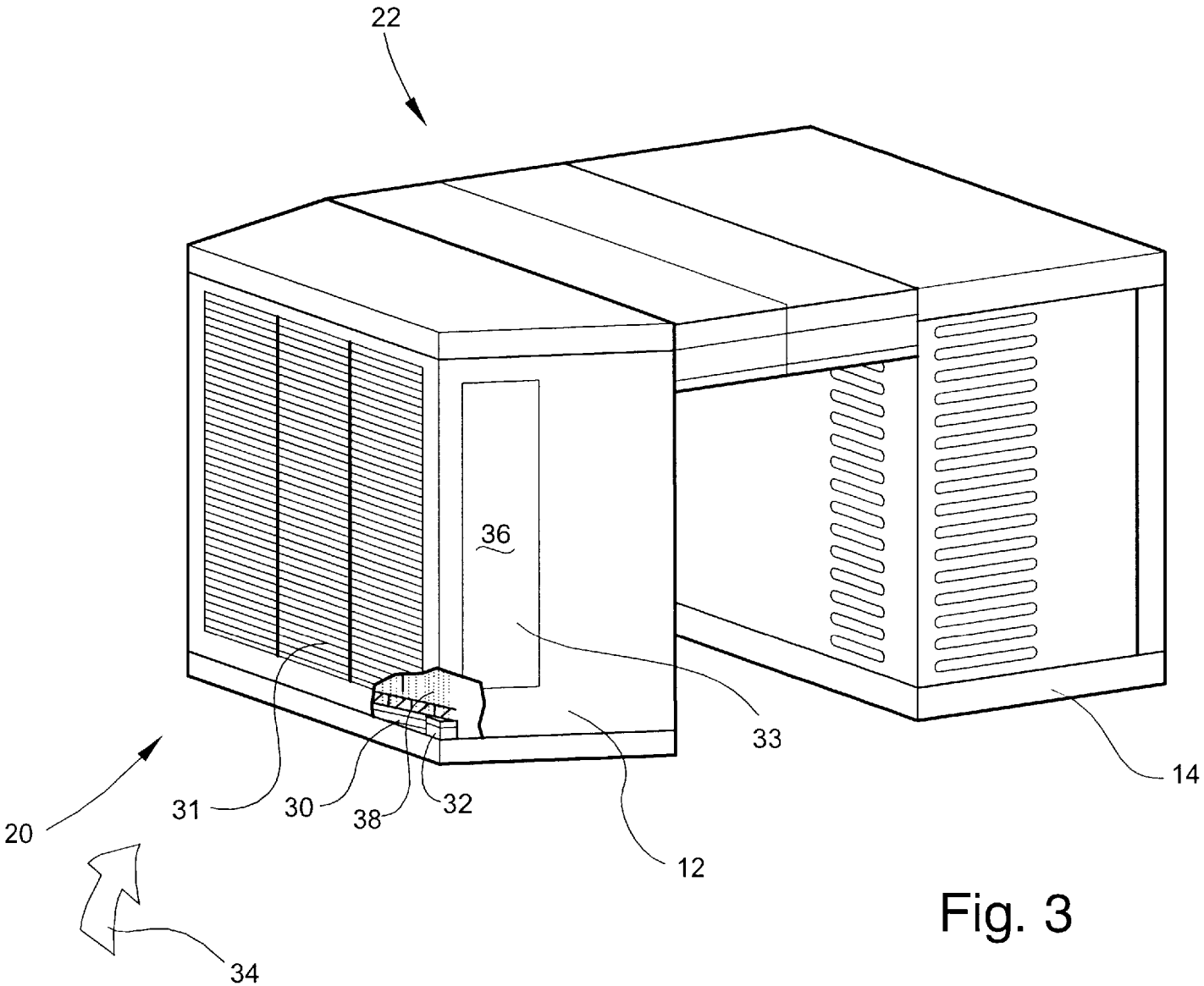
FIG. 3 is a detailed view of the saddle air conditioner of FIG. 2.

FIG. 2 illustrates a saddle air conditioner 20 disposed within a window 22. A wall 24 may contain the window 22 and create a division identified as indoor 26 and outdoor 28. FIG. 3 is a detailed view of the saddle air conditioner 20 of FIG. 2. The saddle air conditioner 20 may include Bridge 29. Bridge 29 may be disposed between the local unit 12 and the remote unit 14 to provide structural support and to permit tubing for air, condensate water, coolant, and electricity to pass between each unit.

Referring to FIG. 3, the local unit 12 may include a grill 31, a louver 33, evaporator coils 35, a pan 30, and a bracket 32. The evaporator coils 35 may be disposed behind the grill 31 to receive warm air 34 through the grill 31 and to aid in passing the warm air 34 to the louver 33 as cooled air 36. As the warm air 34 passes through the evaporator coils 35, atmospheric moisture may condense onto the evaporator coils 35 and drip downward. The pan 30 may be fixed to the bracket 32 below the evaporator coils 35 to collect these drops as condensate 38. A condensate pumping system 40 of FIG. 4 may be used to remove the condensate 38 from the pan 30.

Figure 4:
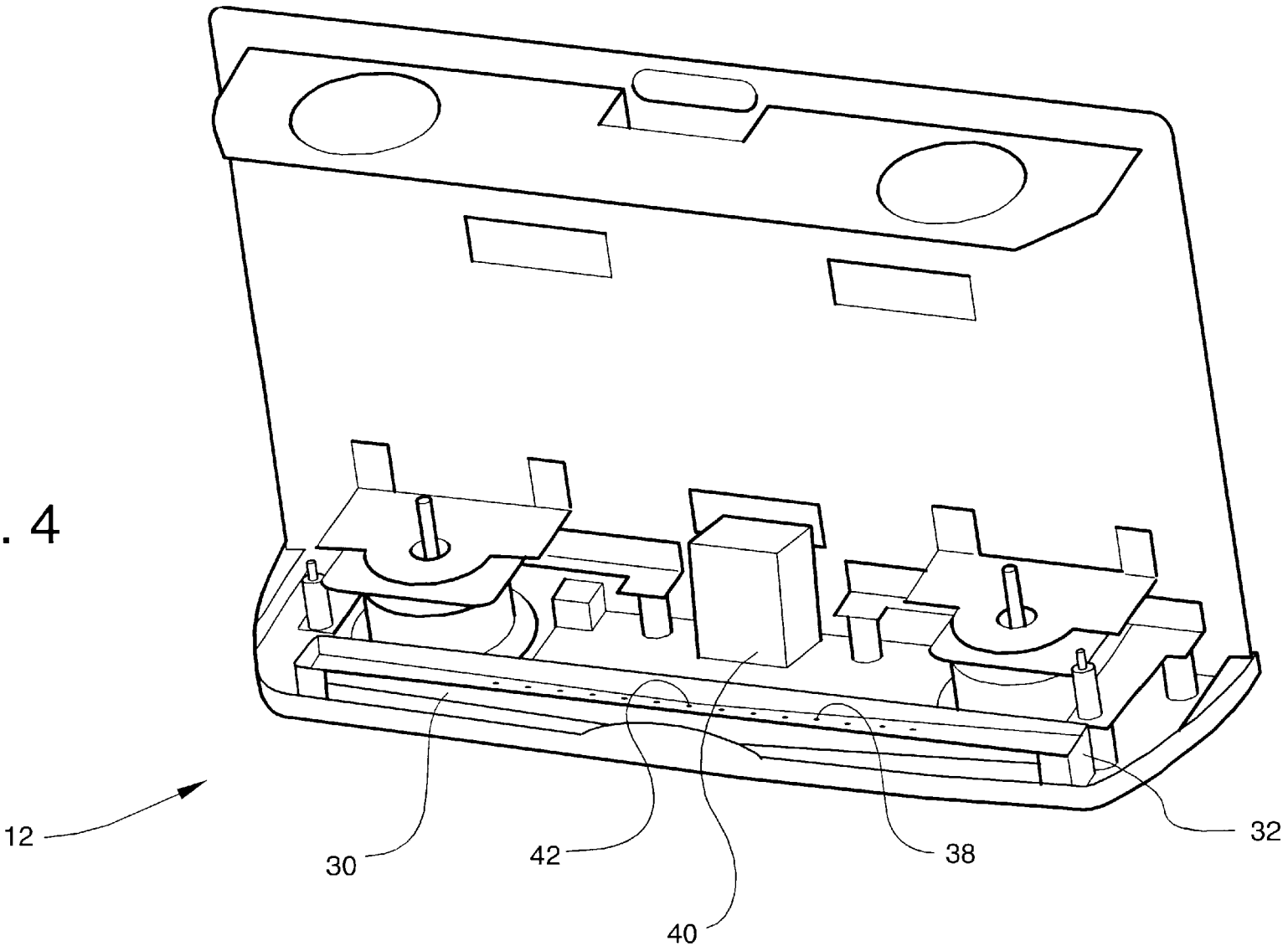
FIG. 4 is a front isometric view of a local unit with parts removed to reveal the collecting part of the condensate pumping system.
Figure 5:
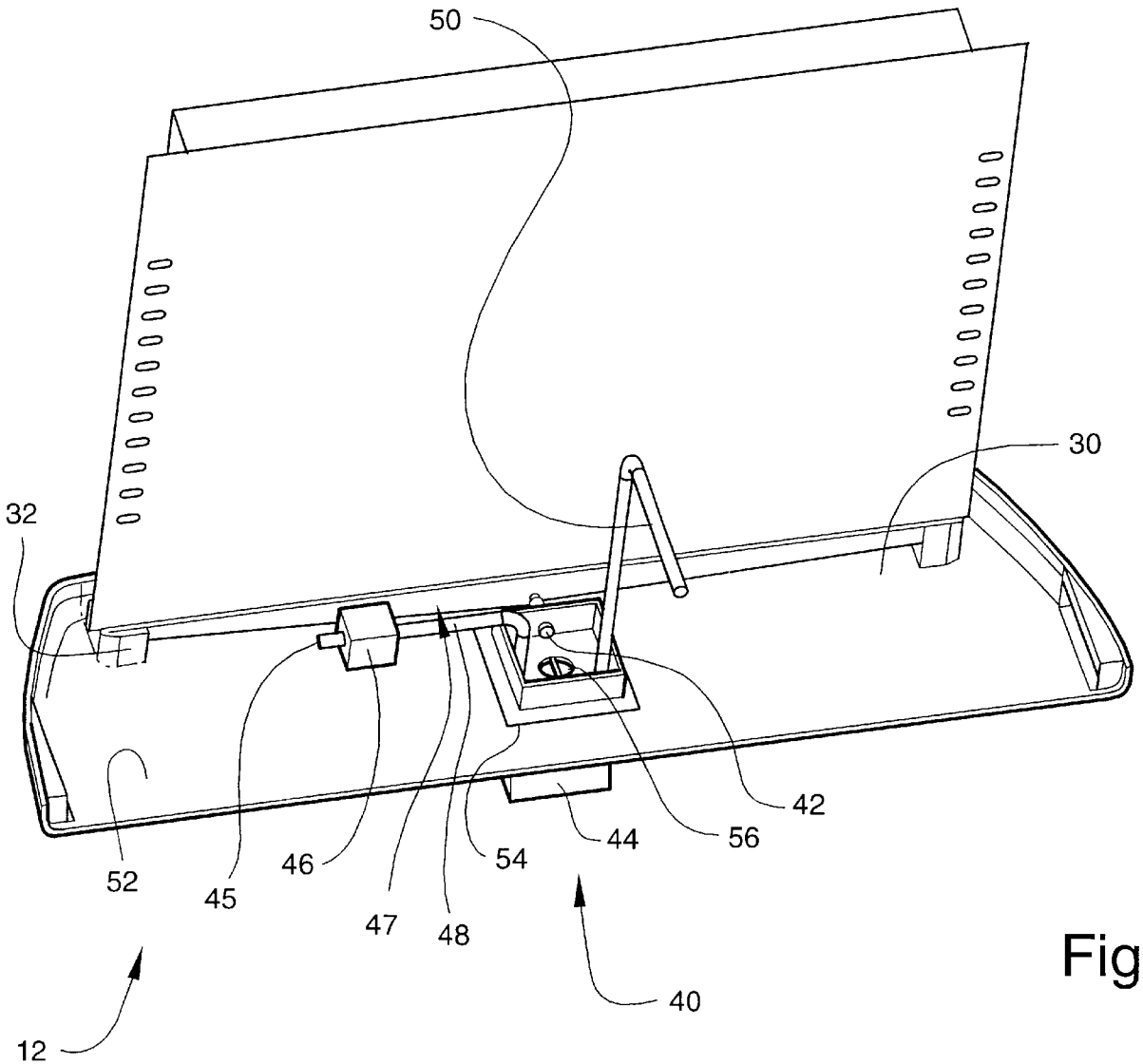
FIG. 5 is a rear isometric view of the local unit with parts removed to reveal the collecting part of the condensate pumping system.

FIG. 4 is a front isometric view of the local unit 12 with parts removed to reveal the condensate pumping system 40. The pan 30 may communicate the condensate 38 to the condensate pumping system 40 through a bung 42. FIG. 5 is a rear isometric view of the local unit 12 with parts removed to reveal the condensate pumping system 40.

As seen in FIG. 5, included with the condensate pumping system 40 may be a tank 44, an air pump 46 which can be located in the outdoor section for quieter operation, an air tube 48, and a condensate tube 50. The tank 44 may be any container adapted to hold water. An interior of the tank 44 may define a sump 51. In one embodiment, a perimeter of the tank 44 defines one of a square and a circle. The tank 44 may be secured to a base 52 of the local unit 12 by a lip 54.

The air pump 46 may be any equipment designed to force a flow of a gas, preferably air, from a first location to a second location. The air pump 46 may include an inlet 45 and an outlet 47. The air tube 48 may provide a pathway for air to travel from the outlet 47 of the air pump 46 and the tank 44. The condensate tube 50 may provide a pathway for the condensate 38 to travel from the tank 44.

Figure 6:
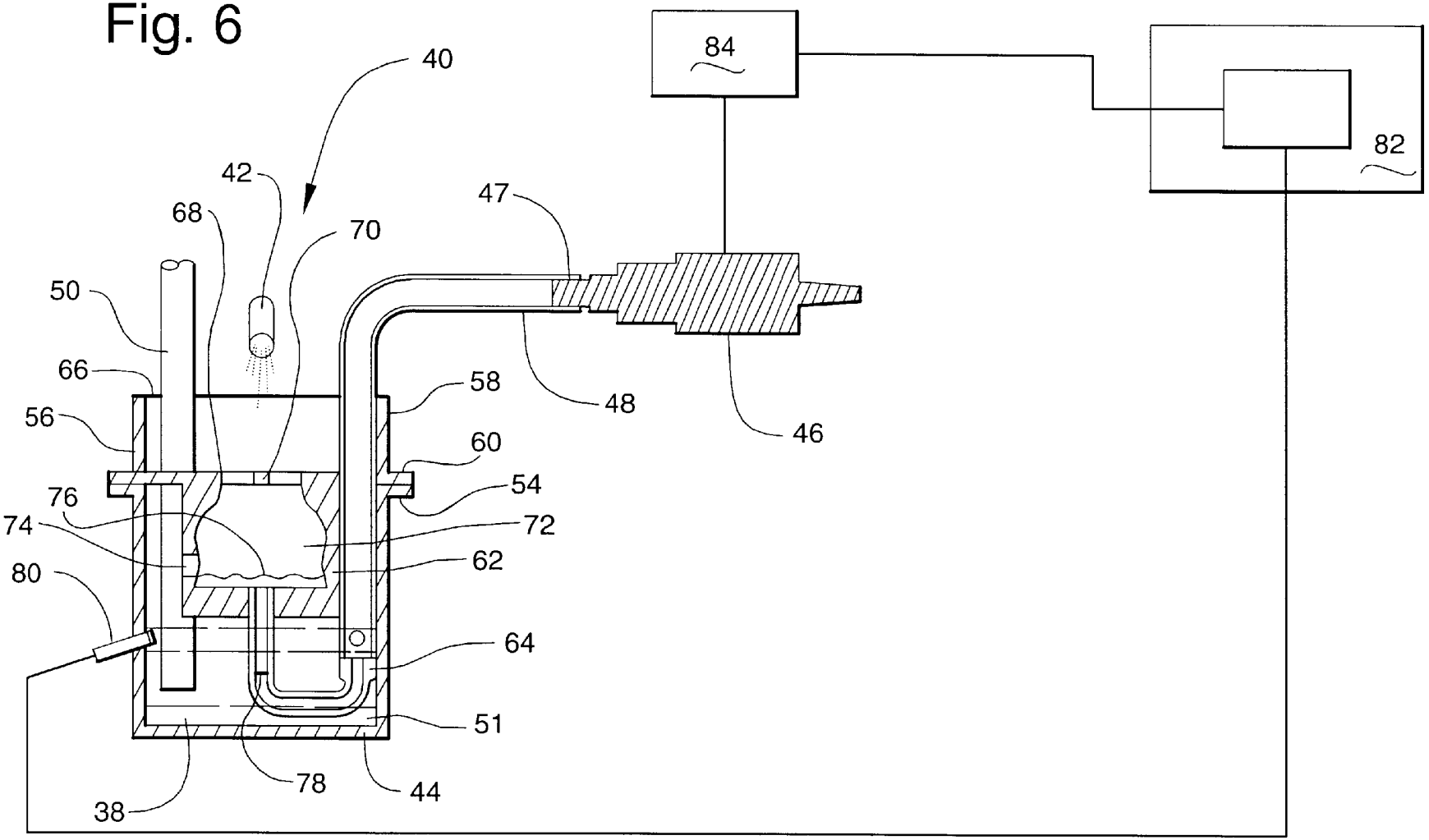
FIG. 6 is a schematic view of the condensate pumping system of FIG. 5.

FIG. 6 is a schematic view of the condensate pumping system 40 of FIG. 5. The condensate pumping system 40 may further include a restrictor 56. The restrictor 56 may include upper walls 58, an upper plate 60, lower walls 62, and a lower plate 64. The upper walls 58 may extend from the upper plate 60 to define an upper reservoir 66. The bung 42 may be arranged to deposit the condensate 38 into the upper reservoir 66. In one embodiment, the bung 42 is disposed through the upper walls 58.

The upper plate 60 may include an orifice 68 and a bar 70. The bar 70 may extend across a center of the orifice 68 to divide the orifice 68 into at least two holes. Alternatively, a mesh screen may divide the orifice 68. The lower walls 62 may extend from the upper plate 60 to the lower plate 64 to define a lower reservoir 72. To provide a path for the condensate 38 to travel from the orifice 68 to the sump 51, the lower walls 62 may include an orifice 74.

The condensate pumping system 40 further may include a diaphragm 76. The diaphragm 76 may be a flexible disk made from an expandable material, such as rubber. The diaphragm 76 may be secured in the lower reservoir 72 by the lower plate 64 at a position that is below the orifice 68. Alternatively, the diaphragm 76 may be disposed within or above the orifice 68.

The lower plate 64 further may couple the air tube 48 to an interior of the diaphragm 76. The air tube 48 may pass at a low point within the sump 51. At this point, the air tube 48 may include a one way valve 78. The one way valve 78 may permit pressurized air to pass from the air tube 48 to the sump 51 while preventing the condensate 38 from passing from the sump 51 into the air tube 48. For example, the one way valve 78 may be a check valve or a small diameter pin hole.

The condensate pumping system 40 may also include a probe 80, an electronic control 82, and a switch 84. The probe 80 may be disposed within the sump 51 at a first end and coupled to the computer 82 at a second end. The probe 80 may be any device that is adapted to sense the depth level of the condensate 38 within the sump 51.

The electronic control 82 may be any machine that can be programmed to manipulate symbols. The electronic control 82 may receive a signal from the probe 80 or from some other source such as a timer and, in response, transmit its own signal to the switch 84. The switch 84 may be coupled between the electronic control 82 and the air pump 46 to activate or deactivate the air pump 46 based on a signal from the computer 82.

Figure 7:
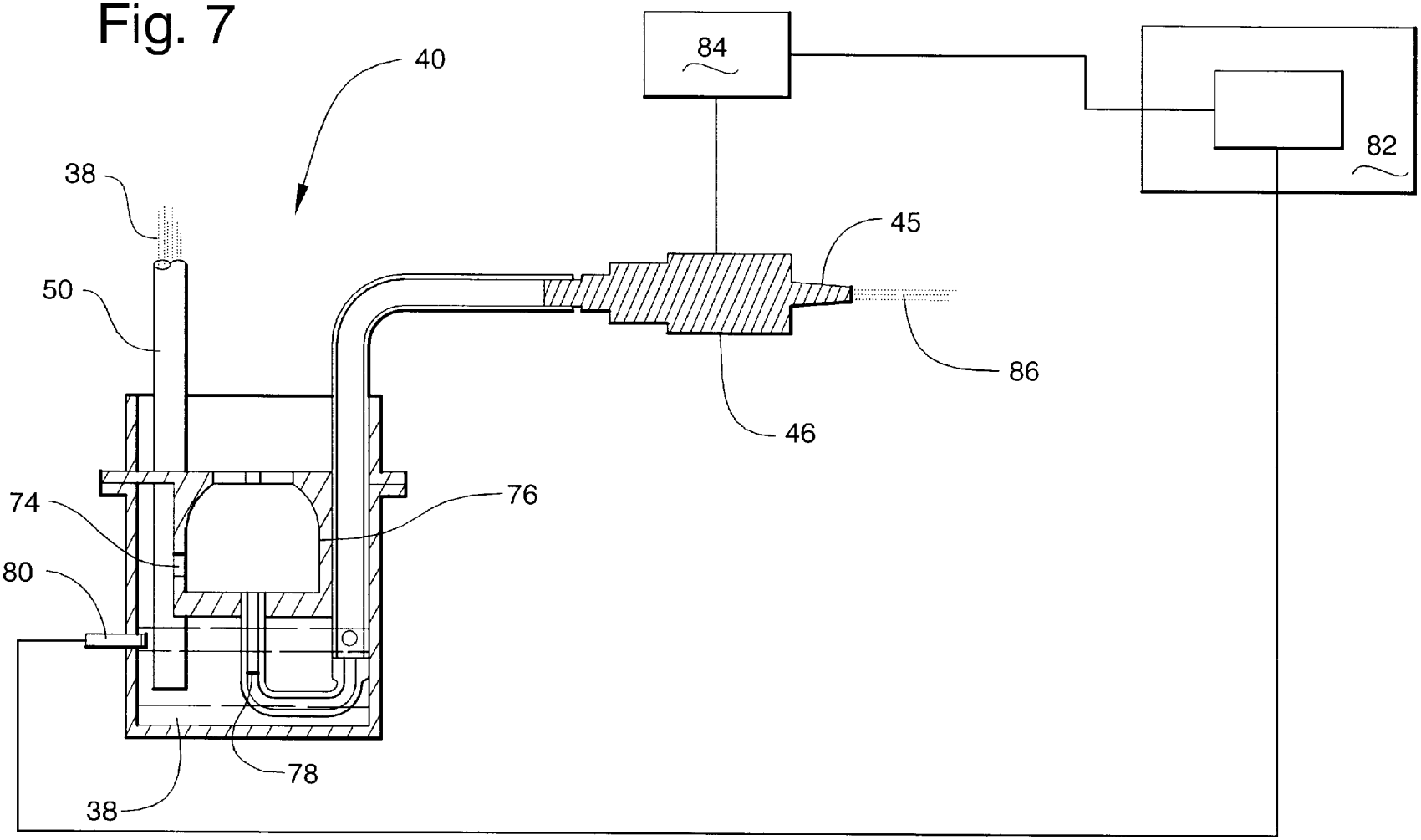
FIG. 7 illustrates an expanded diaphragm.

FIG. 7 illustrates an expanded diaphragm 76. In operation, the diaphragm 76 receives air 86 as pressurized from the air pump 46 and expands to seal the orifice 68. This, in turn, may cause the pressure of the air 86 within the air tube 48 to increase and force the air 86 into the sump 51 through the one way valve 78. The air 86 may then act on the surface of the condensate 38 within the sump 51 to force the condensate 38 up the condensate tube 50.

Figure 8:
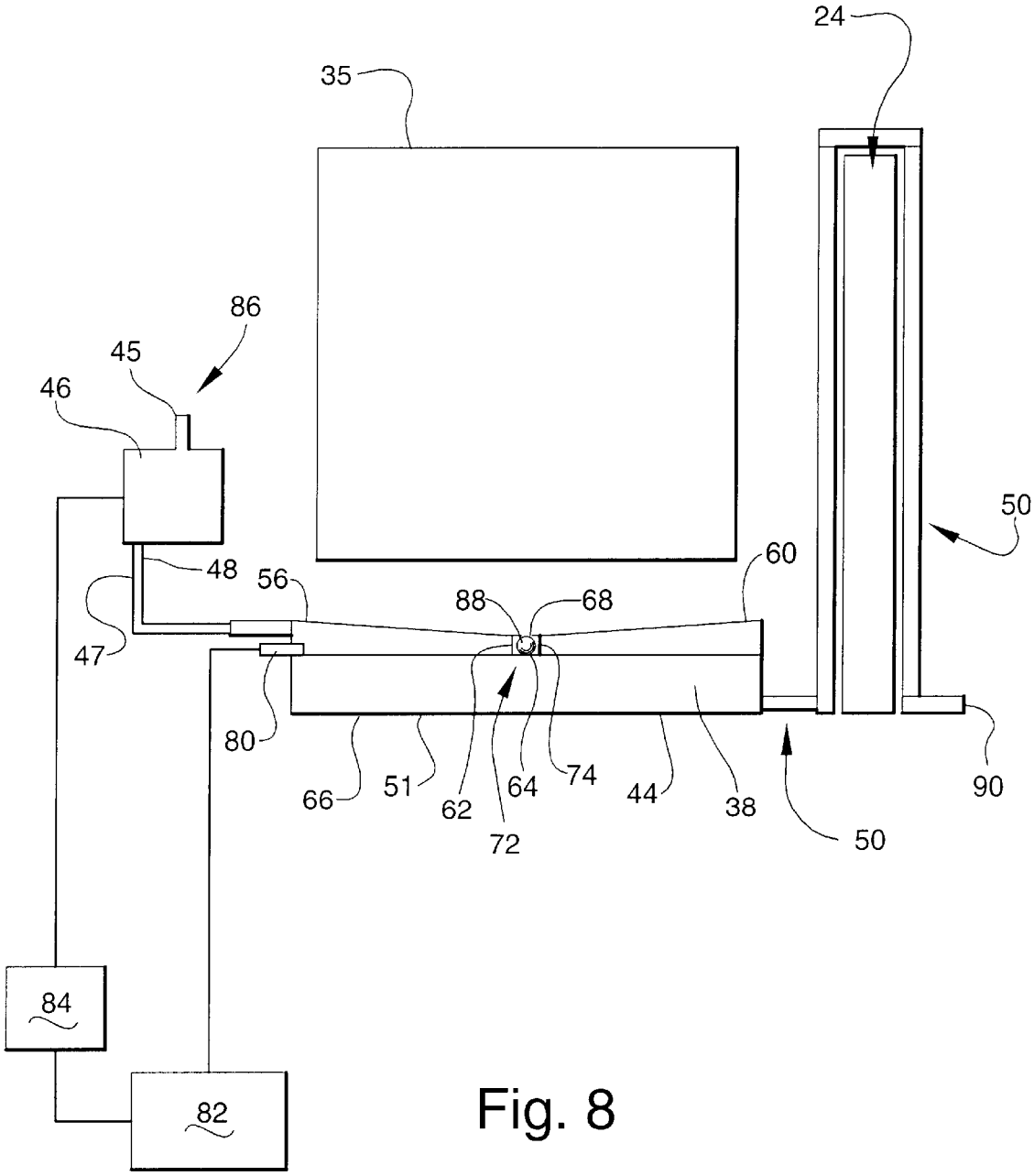
FIG. 8 illustrates an alternate technique to seal an orifice.

FIG. 8 illustrates an alternate technique to seal the orifice 68. Rather than including the diaphragm 76, the condensate pumping system 40 may include a ball 88 residing within the lower reservoir 72. The ball 88 may be a float having a density that is less than a density of water so as to be adapted to float on a surface of the condensate 38.

As the level of the condensate 38 within the sump 51 rises, the ball 88 may float to meet the orifice 68, form a meniscus seal between the ball 88 and the orifice 68 to adhere these two elements together through surface tension. The sump 51 may then receive the air 86 as pressurized from the air pump 46. The pressure of the air 86 within the sump 51 may act on the surface of the condensate 38 within the sump 51 to force the condensate 38 up the condensate tube 50.

The pressure of the air 86 within the sump 51 also may act on the surface of the ball 88. Since the pressure of the air 86 within the sump 51 plus the adhesive force of the meniscus seal between the ball 88 and the orifice 68 may be greater than the force of gravity plus atmospheric air pressure acting down on the ball 88, the ball 88 may continue to seal the orifice 68 even when the upper surface of the condensate 38 within the sump 51 drops below the bottom of the ball 88. This difference in force may be increased where the surface area of the ball 88 disposed within the lower reservoir 72 is greater than the surface area of the ball 88 disposed within the upper reservoir 66 through the orifice 68. In one embodiment, a diameter of the ball 88 is greater than a diameter of the orifice 68. The ball 88 may drop from the orifice 68 through the weight of additional condensate 38 within the upper reservoir 66 acting on the ball 88, by lowering the pressure of the air 38 within the lower reservoir 72, or a combination thereof.

As seen in FIG. 8, the condensate tube 50 may be arranged in a twenty-four inches high, inverted U shape over the wall 24 and filled with the condensate 38 by the air pump 46 until atmospheric pressure is sufficient to aid in drawing the condensate 38 from the tank 44 over the wall 24 and out a remote end 90. To aid in this siphoning action, the remote end 90 may be located at an elevation that is lower than the elevation of the condensate tube 50 end local to the tank 44. Here, the air pump 46 may be shut off prior to removal of all of the condensate 38 from the tank 44 so as to permit the siphoning action of atmospheric pressure to draw the remaining condensate 38 from the tank 44.

Figure 9:
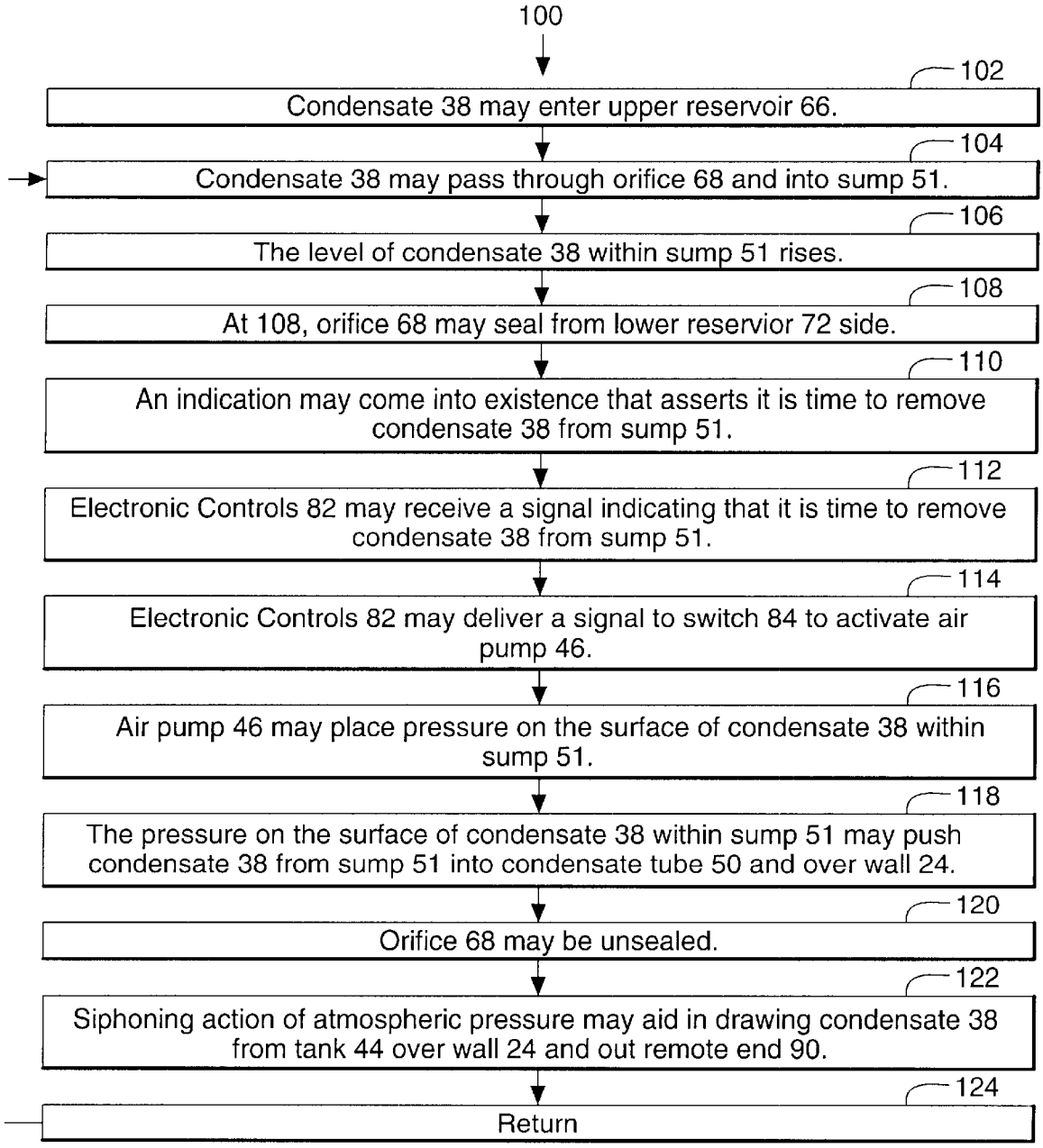
FIG. 9 illustrates a method incorporating principles of the invention.

FIG. 9 illustrates a method 100 incorporating the principles of the invention. At Step 102, the condensate 38 may enter the upper reservoir 66. This may be either directly from the evaporator coils 35 or indirectly from the pan 30 through the bung 42. At Step 104, the condensate 38 may pass through the orifice 68 and into the sump 51. At Step 106, the level of the condensate 38 within the sump 51 rises.

At Step 108, the orifice 68 may seal from the lower reservoir 72 side. This may be by the ball 88 floating to meet the orifice 68 as discussed in connection with FIG. 9. Alternatively, the orifice 68 may sealed from the lower reservoir 72 side by the air pump 46 inflating the diaphragm 76 to engage the orifice 68. At Step 110, an indication may come into existence that asserts it is time to remove the condensate 38 from the sump 51.

At Step 112, the electronic control 82 may receive a signal indicating that it is time to remove the condensate 38 from the sump 51. The signal received by the computer 82 may be based on the depth level of the condensate 38 within the sump 51 as indicated by the probe 80. Moreover, the signal received by the electronic control 82 may be based on the length of time the split air conditioner 10 has been in operation. Further, the signal received by the electronic control 82 may be based on the weight of the condensate 38 within the sump 51. For example, the tank 44 may be located on a pivot point where the weight of the condensate 38 within the sump 51 tilts, the tank 44 into contact with a switch that generates the signal to the computer 82. The Ball 88 may complete a circuit on engaging the orifice 68 to generate the signal to the electronic control 82.

At Step 114, the electronic control 82 may deliver a signal to the switch 84 to activate the air pump 46. At Step 116, the air pump 46 may place pressure on the surface of the condensate 38 within the sump 51. At Step 118, the pressure on the surface of the condensate 38 within the sump 51 may push the condensate 38 from the sump 51 into the condensate tube 50 and over the wall 24. At Step 120, the orifice 68 may be unsealed. Turning off the air pump 46 may unseal the orifice 68. The air pump 46 may be turned off after a fixed amount of time or based on the depth or weight level of the condensate 38 within the sump 51. At Step 122, siphoning action of atmospheric pressure may aid in drawing the condensate 38 from the tank 44 over the wall 24 and out the remote end 90. At Step 124, the method 100 may return to Step 104.

The exemplary embodiments described herein are provided merely to illustrate the principles of the invention and should not be construed as limiting the scope of the subject matter of the terms of the claimed invention. The specification and drawings are, accordingly, to be regarded in an illustrative rather than a restrictive sense. Moreover, the principles of the invention may be applied to achieve the advantages described herein and to achieve other advantages or to satisfy other objectives, as well.

What is claimed is:

1. A liquid pumping system, comprising a tank having an upper reservoir and a sump disposed below the upper reservoir, wherein the upper reservoir includes an orifice and is adapted to receive liquid condensate;

a seal mechanism arranged at the orifice;

a liquid tube coupled to the sump; and an air pump coupled to the sump through an air tube.

2. The liquid pumping system of claim 1, wherein the liquid is condensate and the seal mechanism includes a diaphragm coupled to the air tube.

3. The condensate pumping system of claim 2, the tank further having a lower reservoir disposed between the upper reservoir and the sump, wherein the diaphragm is coupled to the air tube at a position below the orifice within the lower reservoir and wherein the air pump is coupled to the sump through a one way valve in the air tube.

4. The condensate pumping system of claim 3, wherein the one way valve is a check valve.

5. The condensate pumping system of claim 2, wherein the orifice includes at least one bar that divides the orifice into at least two portions.

6. The condensate pumping system of claim 2 further comprising:

an electronic control;

a probe having a first end disposed within the sump and a second end coupled to the electronic control; and a switch having a first end coupled to the electronic control and a second end coupled to the air pump.

7. The liquid pumping system of claim 1, the tank further having a lower reservoir disposed between the upper reservoir and the sump, wherein the seal mechanism includes a float disposed within the lower reservoir.

8. The liquid pumping system of claim 7, wherein the liquid is condensate and the float is a ball having a density that is less than a density of water.

9. The condensate pumping system of claim 8, wherein a diameter of the ball is greater than a diameter of the orifice.

10. The liquid pumping system of claim 7 further comprising:

an electronic control;

a probe having a first end disposed within the sump and a second end coupled to the electronic control; and a switch having a first end coupled to the computer and a second end coupled to the air pump.

11. The liquid pumping system of claim 1 wherein the liquid tube includes a local end and a remote end, wherein the local end is coupled to the sump at a first elevation and the remote end is located at a second elevation that is lower than the first elevation.

12. A split air conditioner, comprising:

a remote unit having a heat removal system;

a supply system coupled to the remote unit; and a local unit coupled to the supply system and having a condensate pumping system, wherein the condensate pumping system includes a tank having an upper reservoir and a sump disposed below the upper reservoir, wherein the upper reservoir includes an orifice and is adapted to receive condensate from the local unit, means for sealing the orifice, a condensate tube coupled to the sump, and an air pump coupled to the sump through an air tube.

13. The split air conditioner system of claim 12, wherein the means for sealing the orifice includes a diaphragm coupled to the air tube.

14. The condensate pumping system of claim 13, the tank further having a lower reservoir disposed between the upper reservoir and the sump, wherein the diaphragm is coupled to the air tube at a position below the orifice within the lower reservoir and wherein the air pump is coupled to the sump through a one way valve in the air tube.

15. The condensate pumping system of claim 13 wherein the orifice includes at least one bar that divides the orifice into at least two portions.

16. The condensate pumping system of claim 12, the tank further having a lower reservoir disposed between the upper reservoir and the sump, wherein the means for sealing the orifice includes a float disposed within the lower reservoir.

17. The condensate pumping system of claim 16, wherein the float is a ball having a density that is less than a density of water.

18. A method to push collected condensate from below an evaporator to a remote location, the method comprising the steps of:

providing a tank having an upper reservoir and a sump disposed below the upper reservoir, wherein the upper reservoir includes an orifice, a condensate tube coupled to the sump, and an air pump coupled to the sump through an air tube;

receiving condensate from the evaporator in the upper reservoir;

receiving the condensate in the sump;

sealing the orifice; and pushing the condensate into the condensate tube by pressurizing the sump with air from the air pump.

19. The method of claim 18, wherein the step of sealing the orifice includes moving a diaphragm with air from the air tube until the diaphragm engages the orifice.

20. The method of claim 18, wherein the step of sealing the orifice includes floating a ball on a surface of the condensate until the ball engages the orifice.

* * * * *

UNITED STATES PATENT AND TRADEMARK OFFICE

CERTIFICATE OF CORRECTION

PATENT NO. : 6,389,834 B1
APPLICATION NO. : 09/789199
DATED : May 21, 2002
INVENTOR(S) : Douglas David LeClear et al.

It is certified that error appears in the above-identified patent and that said Letters Patent is hereby corrected as shown below:

Title page, item (75) should read as follows Douglas David LeClear, Coloma;
Guolian Wu, St. Joseph;
Kenneth Paul Scheffler, Benton Harbor
Jim J. Pastryk, Sawyer, all of MI (US)

Signed and Sealed this

Seventeenth Day of July, 2007

JON W. DUDAS
*Director of the United States Patent and Trademark Office*